US010761462B2

(12) United States Patent
Yuge

(10) Patent No.: US 10,761,462 B2
(45) Date of Patent: Sep. 1, 2020

(54) ENERGY SAVINGS IN AN IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Keiji Yuge, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/848,889

(22) Filed: Apr. 15, 2020

(65) Prior Publication Data

US 2020/0241455 A1 Jul. 30, 2020

Related U.S. Application Data

(60) Continuation of application No. 16/574,139, filed on Sep. 18, 2019, now Pat. No. 10,656,577, which is a continuation of application No. 16/228,997, filed on Dec. 21, 2018, now Pat. No. 10,459,381, which is a division of application No. 15/708,378, filed on Sep. 19, 2017, now Pat. No. 10,197,956.

(51) Int. Cl.
*G03G 15/20* (2006.01)

(52) U.S. Cl.
CPC ..... *G03G 15/2039* (2013.01); *G03G 15/205* (2013.01)

(58) Field of Classification Search
None
See application file for complete search history.

(56) References Cited

U.S. PATENT DOCUMENTS

| | | | |
|---|---|---|---|
| 10,197,956 | B1 | 2/2019 | Yuge |
| 2008/0317491 | A1 | 12/2008 | Kawakami et al. |
| 2011/0091229 | A1 | 4/2011 | Seol et al. |
| 2013/0084091 | A1 | 4/2013 | Taki et al. |
| 2013/0251390 | A1 | 9/2013 | Ishii et al. |
| 2014/0376940 | A1 | 12/2014 | Wagatsuma |
| 2015/0153691 | A1 | 6/2015 | Ono |
| 2015/0220029 | A1 | 8/2015 | Samei et al. |
| 2015/0253704 | A1 | 9/2015 | Hirose et al. |
| 2018/0329342 | A1 | 11/2018 | Seshita et al. |
| 2018/0335748 | A1 | 11/2018 | Shimizu et al. |

FOREIGN PATENT DOCUMENTS

| | | |
|---|---|---|
| JP | 1995-248695 | 9/1995 |

*Primary Examiner* — Sevan A Aydin
(74) *Attorney, Agent, or Firm* — Amin, Turocy & Watson, LLP

(57) ABSTRACT

According to embodiments, an image forming apparatus includes a fixation member, a pressurization member, a heat source, a drive unit, a measurement unit, and a control unit. The measurement unit measures the time that elapses after the image forming apparatus ends image forming processing until the image forming apparatus receives an instruction to perform the next image forming processing. If the elapsed time does not exceed a predetermined threshold, the control unit causes the drive unit to start to drive the fixation member after a temperature of the fixation member reaches a first control temperature. If the elapsed time exceeds the predetermined threshold, the control unit causes the drive unit to start to drive the fixation member after the temperature of the fixation member reaches a second control temperature that is higher than the first control temperature.

17 Claims, 14 Drawing Sheets

FIG. 11

| SECOND CONTROL TEMPERATURE (°C) | OCCURRENCE SITUTATION OF COLLISION SOUND | | | |
|---|---|---|---|---|
| | 0 SECONDS | 4 SECONDS | 8 SECONDS | 12 SECONDS |
| 120 | × | × | × | △ |
| 140 | × | × | △ | ○ |
| 160 | × | △ | ○ | ○ |
| 180 | △ | ○ | ○ | ○ |
| 200 | ○ | ○ | ○ | ○ |

ENERGY SAVINGS IN AN IMAGE FORMING APPARATUS

CROSS-REFERENCE TO RELATED APPLICATIONS

This application is a Continuation of application Ser. No. 16/574,139 filed on Sep. 18, 2019, which is a Continuation of application Ser. No. 16/228,997 filed on Dec. 21, 2018, now U.S. Pat. No. 10,459,381, which is a Divisional of application Ser. No. 15/708,378 filed on Sep. 19, 2017, now U.S. Pat. No. 10,197,956, the entire contents of both of which are incorporated herein by reference.

FIELD

Embodiments described herein relate generally to energy savings in an image forming apparatus and methods related thereto.

BACKGROUND

In the related art, there are image forming apparatuses that cause a toner image to be fixed on an image formation medium (hereinafter referred to as a "sheet") using a fixation roller and a pressurization roller that is pressure-contacted with the fixation roller. In this case, a fixation roller and a pressurization roller are rotated with the sheet being squeezed between the fixation roller and the pressurization roller, and thus heat of the fixation roller is transferred to the sheet. With the heating by the fixation roller, the toner image is fixed to the sheet. In this case, the image forming apparatus controls a temperature of the fixation roller, and rotation speeds of the fixation roller and the pressurization roller, in such a manner that the toner image is suitably fixed on the sheet.

On the other hand, for the purpose of saving energy, image forming apparatuses are being developed that transition to an operation mode for low power if a state of the image forming apparatus satisfies a predetermined condition. A state where the image forming apparatus operates in a low power mode is hereinafter referred to as a "sleep state". However, if the image forming apparatus is in the sleep state for a predetermined time or longer, there is a likelihood that transformation will occur between a pressure contact portion between the pressurization roller and the fixation roller. This is because the pressurization roller that is hardened by the heat of the fixation roller is left unattended (naturally cooled) and thus is hardened in a state of being pressure-contacted with the fixation roller. This transformation is generally referred to as a creep, and is known to be a cause of the occurrence of various defects in the image forming apparatus and printed sheets produced by the image forming apparatus.

In the related art, although research is conducted on the technology of reducing the number of defects that occur due to this creep, suppression of strange sounds of a drive unit, which occur when the fixation roller is rotated have not yet been achieved.

BRIEF DESCRIPTION OF THE DRAWINGS

FIG. 11 is a diagram illustrating a specific example of a functional configuration of an image forming apparatus according to a second embodiment.

DETAILED DESCRIPTION

An image forming apparatus according to the embodiment has a fixation member, a pressurization member, a heat source, a drive unit, a measurement unit, and a control unit. The pressurization member is pressure-contacted with the fixation member. The heat source heats the fixation member. The drive unit provides a drive force to the fixation member. The measurement unit measures the time that elapses after the image forming apparatus itself ends certain image forming processing until the image forming apparatus itself receives an instruction to perform next image forming processing. The control unit causes the heat source to start to heat the fixation member, as an operation that is to be prepared before performing the next image forming processing, according to reception of the instruction for performing. If the elapsed time does not exceed a predetermined threshold, the control unit causes the drive unit to start to drive the fixation member after a temperature of the fixation member reaches a first control temperature. If the elapsed time exceeds the predetermined threshold, the control unit causes the drive unit to start to drive the fixation member after the temperature of the fixation member reaches a second control temperature that is higher than the first control temperature.

The image forming apparatus according to the embodiment will be described above with reference to the drawings.

First Embodiment

Figure 1:
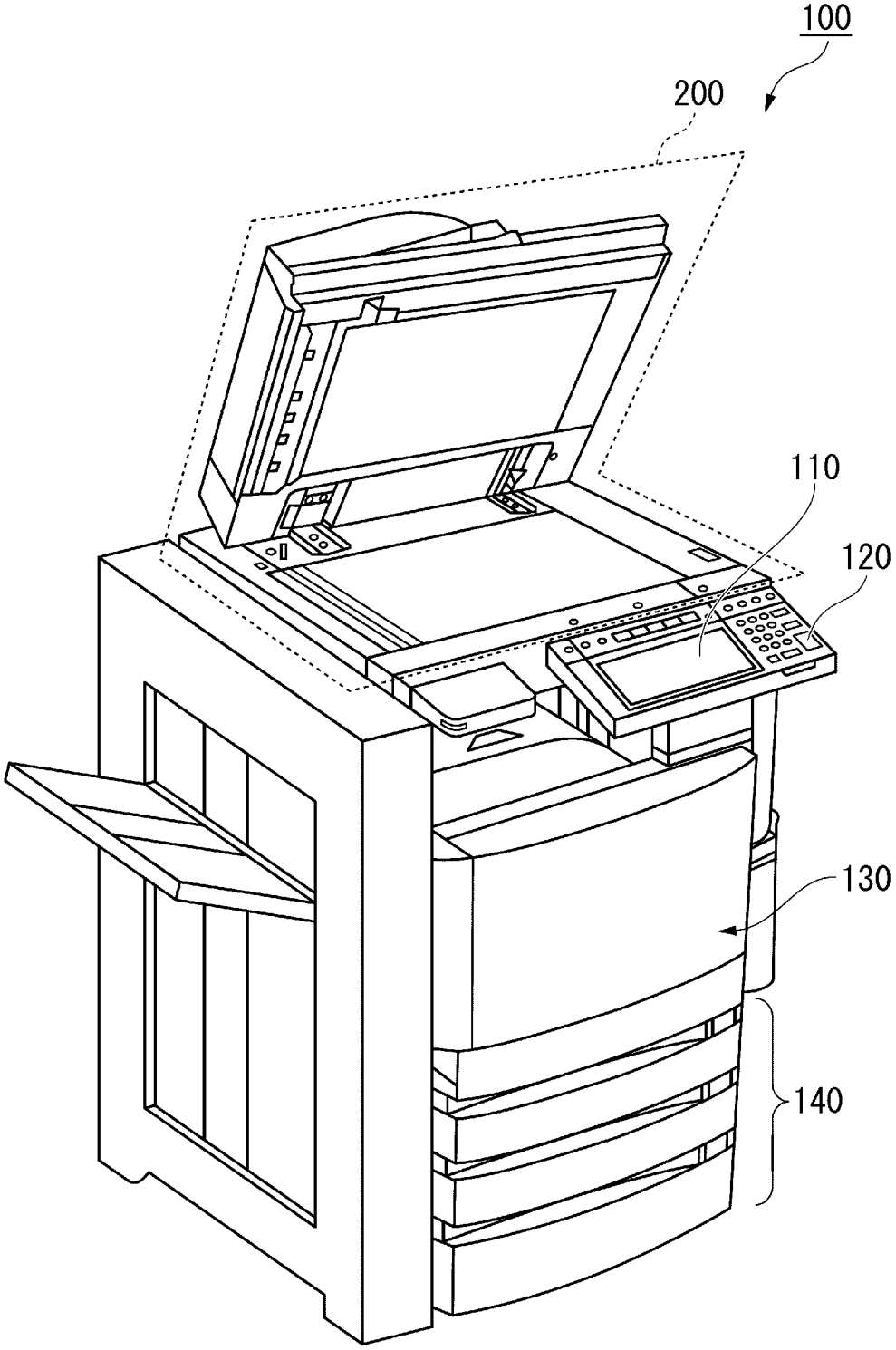
FIG. 1 is an external appearance diagram illustrating an example of an entire configuration of an image forming apparatus according to a first embodiment.

FIG. 1 is an external appearance diagram illustrating an example of an entire configuration of an image forming apparatus 100 according to a first embodiment. The image forming apparatus 100 is, for example, a multi-function machine. The image forming apparatus 100 includes a display 110, a control panel 120, a printing unit 130, a sheet accommodating unit 140, and an image reading unit 200. The image forming apparatus 100 forms an image on a sheet using a developing agent such as a toner. The sheet, for example, is a sheet of paper or a label. The sheet may be any material, on a surface of which the image forming apparatus 100 can form an image.

The display 110 is an image display device, such as a liquid crystal display or an organic electro luminescence display (EL) display. Displayed on the display 110 are various pieces of information relating to the image forming apparatus 100.

The control panel 120 has a plurality of buttons. A user operation is performed on the control panel 120. The control panel 120 outputs a signal in accordance with the operation that is performed by a user, to a control unit of the image forming apparatus 100. It is noted that the display 110 and the control panel 120 may be configured to be integrated into a touch panel.

The printing unit 130 forms an image on a sheet, based on image information that is generated by the image reading unit 200, or image information that is received through a communication path. For example, with the following processing, the printing unit 130, for example, forms an image. An image forming module of the printing unit 130 forms an electrostatic latent image on a photosensitive drum based on the image information. The image forming module of the printing unit 130 forms a visible image by causing the developing agent to be adhered to the electrostatic latent image. As a specific example of the developing agent, there is a toner. A transfer module of the printing unit 130 transfers the visible image on a sheet. A fixation unit of the printing unit 130 causes the visible image to be fixed to the sheet by performing heating and pressurization on the sheet. It is noted that the sheet on which the image is formed may be a sheet that is accommodated in the sheet accommodating unit 140, and be a sheet that is fed by human fingers.

The sheet accommodating unit 140 accommodates a sheet that is used for image formation in the printing unit 130.

The image reading unit 200 reads reading-target image information as light and darkness. The image reading unit 200 records the image information that is read. The image information that is recorded may be transmitted to other information processing apparatus through a network. The recorded image information may be image-formed by the printing unit 130 on a sheet.

Figure 2:
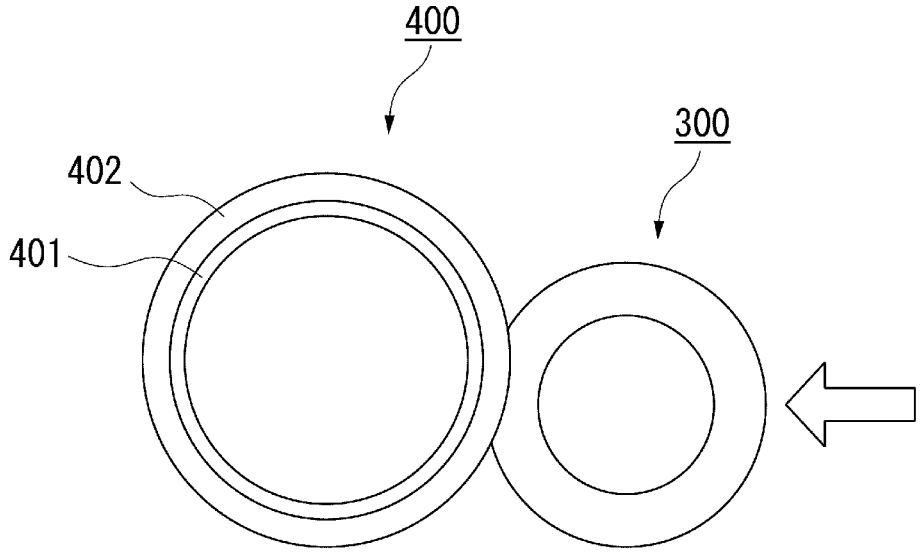
FIG. 2 is a diagram illustrating an outline of a fixation unit in the image forming apparatus according to the first embodiment.

FIG. 2 is a diagram illustrating an outline of a fixation unit in the image forming apparatus 100 according to the first embodiment. The fixation unit includes a pressurization roller 300 and a fixation roller 400. The exertion of a force (hereinafter referred to as a "pressure contact force") in an arrow direction by a pressurization mechanism that is not illustrated pressure-contacts the pressurization roller 300 to the fixation roller 400. The fixation roller 400 has a heater, such as a halogen lamp, inside, and is heated by heat that is emitted by the heater. A sheet is squeezed between the fixation roller 400 and the pressurization roller 300, and the fixation roller 400 transports the sheet by being rotated in cooperation with the pressurization roller 300. The fixation roller 400 pressurizes and heats an abutting surface of a sheet that is fed between the fixation roller 400 itself and the pressurization roller 300, and thus causes a toner image to be fixed to the sheet.

It is noted that the larger the abutting surface, the higher the efficiency with which the pressurization roller 300 and the fixation roller 400 can cause the toner image to be fixed. For this reason, in order to broaden the abutting surface, in most cases, a surface of the pressurization roller 300 is formed using an elastic material, such as rubber that is hardened in the vicinity of a fixation temperature. Furthermore, the fixation roller 400 has a surface layer 402 that is formed using a cored-bar layer 401 made of metal and a resin material, such as polytetrafluoroethylene (PFA) in order to efficiently transfer the heat, which is emitted by the heater, to a surface thereof.

Figure 3:
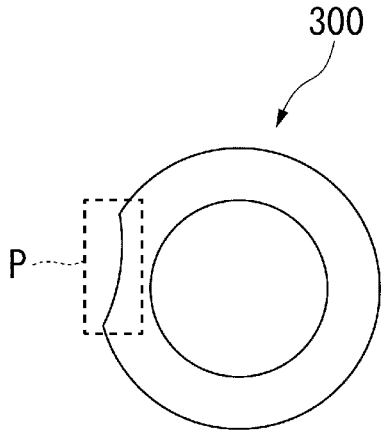
FIG. 3 is a diagram illustrating a specific example of creep that occurs in a pressurization roller according to the first embodiment.

FIG. 3 is a diagram illustrating a specific example of a creep that occurs in the pressurization roller 300 according to the first embodiment. FIG. 3 is an example of the creep p that occurs if the pressurization roller 300 in a state that is illustrated in FIG. 2 is cooled. In this manner, the cooling of the pressurization roller 300 in a state where the fixation roller 400 is pressure-contacted causes a creep P to occur in an abutting portion. An increase in a temperature of the pressurization roller 300 causes the creep P to disappear, but it takes time for the temperature of the pressurization roller 300 to reach a necessary temperature. For this reason, in a situation where a sufficient temperature is not reached, when the pressurization roller 300 is rotated, a situation occurs where the pressure contact force causes the rotation of the fixation roller 400 to be accelerated. Accordingly, teeth of a gear (hereinafter referred to as a "drive gear") that cause the fixation roller 400 to be driven and teeth of a gear on the fixation roller 400 side collide, and a strange sound (hereinafter referred to as "collision sound") occurs.

Figure 4A:
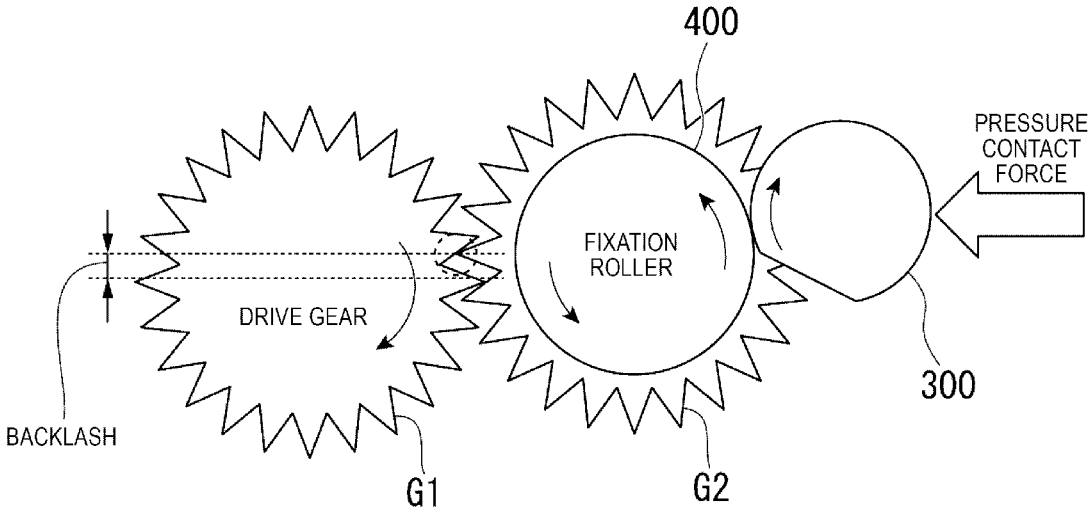
FIGS. 4A and 4B are diagrams for in more detail describing the principle of occurrence of a collision sound according to the first embodiment.
Figure 4B:
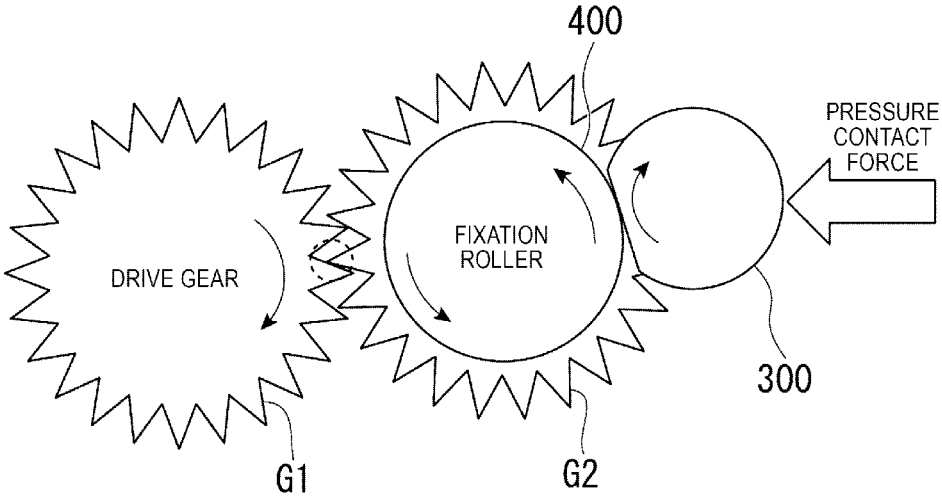

FIGS. 4A and 4B are diagrams for in more detail describing the principle of the occurrence of the collision sound according to the first embodiment. A drive gear G1 that is illustrated in FIGS. 4A and 4B is a drive unit that provides a rotation force to the fixation roller 400. As illustrated in FIG. 4A, the rotation of the drive gear G1 in a state of being engaged with a gear G2 that is connected to a rotation shaft of the fixation roller 400 provides the rotation force in an arrow direction to the fixation roller 400. At this time, as described above, the pressure contact force is applied to the pressurization roller 300. For this reason, when a transition occurs from a state in FIG. 4A, in which the fixation roller 400 and the pressurization roller 300 are brought into contact with a portion other than a creep portion, to a state in FIG. 4B, in which the fixation roller 400 and the pressurization roller 300 are brought into contact with the creep portion, there occurs a situation where the pressurization roller 300 is pushed into the fixation roller 400 side as long a distance as the pressurization roller 300 is recessed due to the creep and where the rotation of the pressurization roller 300 is temporarily accelerated. Accordingly, the rotation of the fixation roller 400 is accelerated as well, and the fixation roller 400 is temporarily rotated at a higher speed than the drive gear G1. As a result, the teeth of the gear G2 progress, while being rotated as great an idle as backlash, and collides with the teeth of the drive gear G1 that precedes the gear G2. At that time, high-volume collision sound occurs. For example, when 50 or more minutes elapse until next image forming processing is performed after certain image forming processing is ended, in some cases, the collision sound occurs at the time of re-driving the fixation roller 400. It is noted that in the drawings, as one example of the drive unit, one drive gear G1 is illustrated, but in the fixation roller 400, power of a motor is transmitted through several gears. For this reason, it is considered that a backlash distance is increased as much as the number of involved gears and thus that high-volume collision sound occurs.

The occurrence of the collision between the teeth of gears is not preferable not only in terms of operation of the apparatus, but also because the collision sound is undesired sound for the user. According to a situation where the creep occurs, the image forming apparatus 100 according to the embodiment has a configuration in which rotation operation of the pressurization roller 300 and heating operation of the fixation roller 400 are controlled. Specifically, the image forming apparatus 100 according to the embodiment can suppress the collision between the teeth of the gears by not causing the pressurization roller 300 to be rotated in a situation where the creep occurs. Furthermore, the image forming apparatus 100 according to the embodiment can cause the creep to be disappeared in a shorter time by controlling a temperature and rotation speed of the fixation roller 400.

Figure 5:
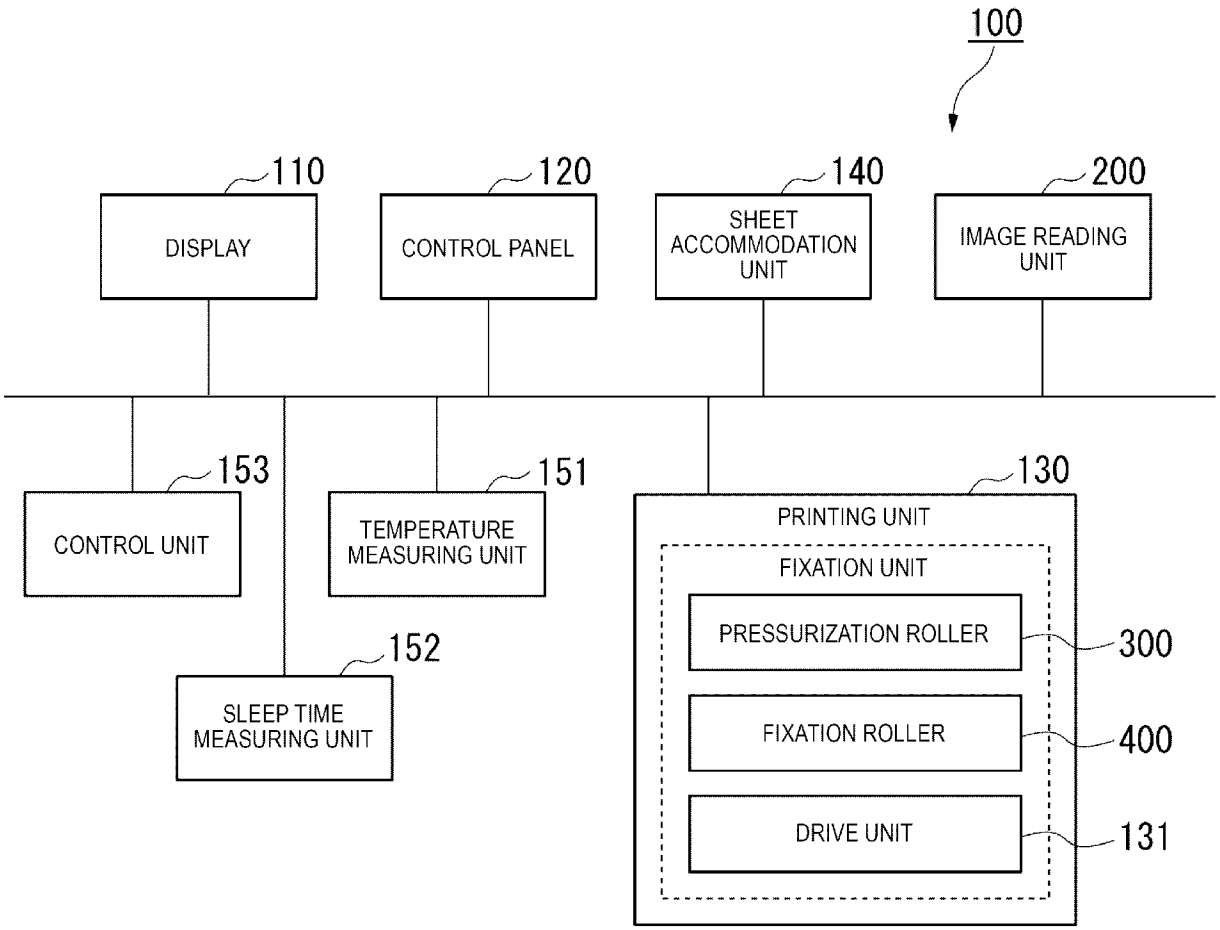
FIG. 5 is a diagram illustrating a specific example of a functional configuration of the image forming apparatus according to the first embodiment.

FIG. 5 is a diagram illustrating a specific example of a functional configuration of the image forming apparatus 100 according to the first embodiment. The image forming apparatus 100 includes a central processing unit (CPU), a memory, an auxiliary storage device, and the like that are connected to each other through a bus and executes a program. With execution of the program, the image forming apparatus 100 functions as an apparatus that includes the display 110, the control panel 120, the printing unit 130, the sheet accommodating unit 140, and the image reading unit 200. It is noted that all portions, or one or several of each function of the image forming apparatus 100 may be realized using a piece of hardware, such as application-specific integrated circuit (ASIC), a programmable logic device (PLD), or a field programmable gate array (FPGA). The program may be recorded in a computer-readable recording medium. For example, the "computer-readable recording medium" refers to a portable medium, such as a flexible disk, a magneto-optical disk, a ROM, and a CD-ROM, and a storage device, such as a hard disk, that is built into the computer system. The program may be communicated through an electric telecommunication line.

The fixation unit of the printing unit 130 includes the pressurization roller 300, the fixation roller 400, and a drive unit 131. The drive unit 131 is a drive unit that provides a rotation force to the fixation roller 400. For example, the drive unit 131 is configured with the drive gear G1 that is illustrated in FIG. 4, a motor that is a power source thereof, and the like. The operation of the drive unit 131 is controlled by a control unit 153.

The temperature measuring unit 151 measures the temperature of the fixation roller 400. A temperature measuring unit 151 outputs temperature information indicating the measured temperature to the control unit 153. It is noted that the temperature of the pressurization roller 300 correlates with the temperature of the fixation roller 400 that heats the pressurization roller 300. Therefore, based on the temperature of the fixation roller 400, it is also possible that the temperature of the pressurization roller 300 is measured. A sleep time measuring unit 152 measures the time (hereinafter referred to as the "sleep time") that elapses from when an image forming apparatus to which the sleep time measuring unit 152 itself belongs to is in a sleep state. The sleep time measuring unit 152 outputs information indicating the measured sleep time (hereinafter referred to as "time information") to the control unit 153.

The control unit 153 (one example of an estimation unit and a control unit) controls each functional unit in such a manner that an apparatus to which the control unit 153 belongs functions as an image forming apparatus. The control unit 153 controls operation of the fixation unit in such a manner that the collision sound due to the creep does not occur in the image forming processing. Specifically, the control unit 153 acquires the temperature information and the time information from the temperature measuring unit 151 and the sleep time measuring unit 152, respectively. Based on the sleep time that is indicated by the acquired time information, the control unit 153 estimates the presence or absence of the creep in the pressurization roller 300. Furthermore, based on the presence or absence of the estimated creep, the control unit 153 controls the operation of the fixation unit.

More specifically, based on the sleep time, the control unit 153 avoids the occurrence of the collision sound by controlling the temperature of and the number of rotations of the pressurization roller 300. The control unit 153 controls the temperature of the pressurization roller 300 by operating control temperature of the fixation roller 400, and controls the number of rotations of the pressurization roller 300 by operating the output of the drive unit 131. A method of controlling the fixation unit will be described in detail below.

Figure 6:
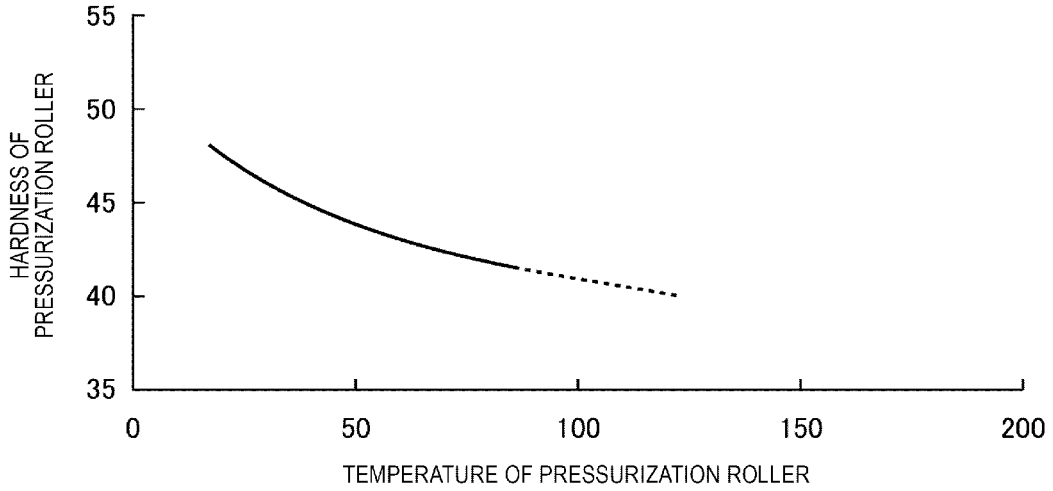
FIG. 6 is a diagram illustrating a specific example of a relationship between a temperature and hardness of the pressurization roller in the image forming apparatus according to the first embodiment.

FIG. 6 is a diagram illustrating a specific example of a relationship between the temperature and hardness of the pressurization roller 300 in the image forming apparatus 100 according to the first embodiment. The horizontal axis in FIG. 6 represents the temperature of the pressurization roller and the vertical axis represents the hardness. As illustrated in FIG. 6, it is understood that the higher the temperature, the hardness of the pressurization roller 300 decreases.

Figure 7:
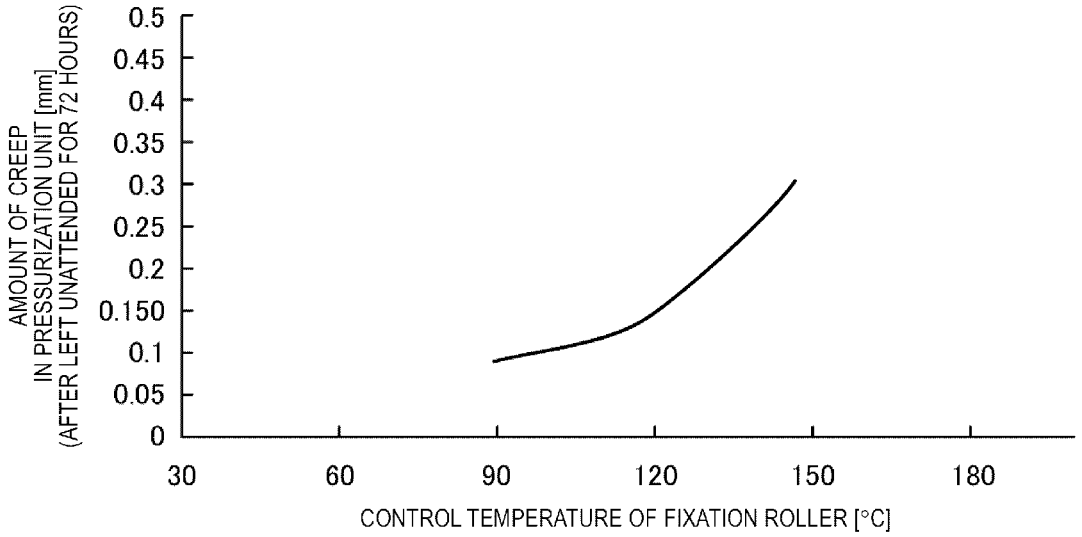
FIG. 7 is a diagram illustrating a specific example of a relationship between a control temperature of a fixation roller and the size of the creep that occurs in the pressurization roller in the image forming apparatus according to the first embodiment.

FIG. 7 is a diagram illustrating a specific example of a relationship between the control temperature of the fixation roller 400 and the size of the creep (hereinafter referred to as an "amount of creep") that occurs in the pressurization roller 300 in the image forming apparatus 100 according to the first embodiment. FIG. 7 illustrates the amount of creep that results after 72 hours elapse after the heating of the fixation roller 400 is stopped. The horizontal axis in FIG. 7 represents the control temperature of the fixation roller 400 at a point in time when the heating is stopped, and the vertical axis represents the amount of creep. As illustrated in FIG. 7, it is understood that the higher the control temperature at the point in time when the heating is stopped, the larger the amount of creep.

Figure 8:
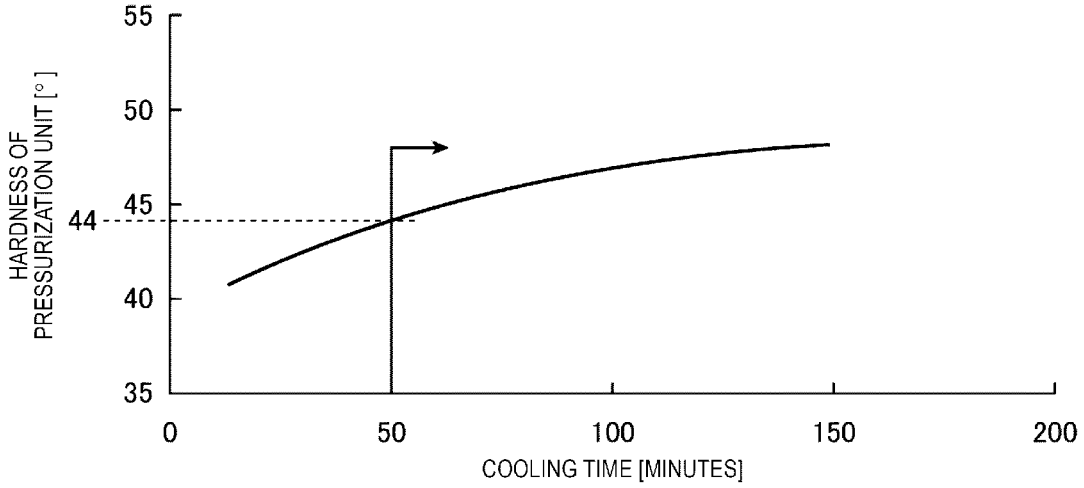
FIG. 8 is a diagram illustrating a specific example of a relationship between the hardness of the pressurization roller and the cooling time in the image forming apparatus according to the first embodiment.

FIG. 8 is a diagram illustrating a specific example of a relationship between the hardness of the pressurization roller 300 and the cooling time in the image forming apparatus 100 according to the first embodiment. The horizontal axis in FIG. 8 represents the cooling time, and the vertical axis represents the hardness of the pressurization roller 300 that results after the pressurization roller 300 is naturally cooled over a period of cooling time that is represented by the horizontal axis. The relationship that is illustrated in FIG. 8 is obtained based on the relationship that is illustrated in FIGS. 6 and 7.

From FIG. 8, it is understood that the hardness of the pressurization roller 300 is 44 degrees over the cooling time period of 50 minutes. At this point, for example, if the hardness of the pressurization roller 300 is equal to or smaller than 44 degrees, it is assumed that the occurrence of the collision sound can be avoided. In this case, the control unit 153 can estimate whether or not the collision sound occurs, depending on determining whether or not the sleep time is equal to or more than 50 minutes.

If the sleep time is less than 50 minutes, if the image forming processing occurs, the control unit 153 can cause the fixation roller 400 to begin to rotate immediately, and thus can cause fixing processing to be quickly performed. On the other hand, if the sleep time is less than 50 minutes, if the image forming processing occurs, the control unit 153 starts to heat the fixation roller 400, and waits for the fixation roller 400 to start to be rotated until the temperature of the pressurization roller 300 reaches a temperature at which the occurrence of the collision sound can be avoided.

Figure 9:
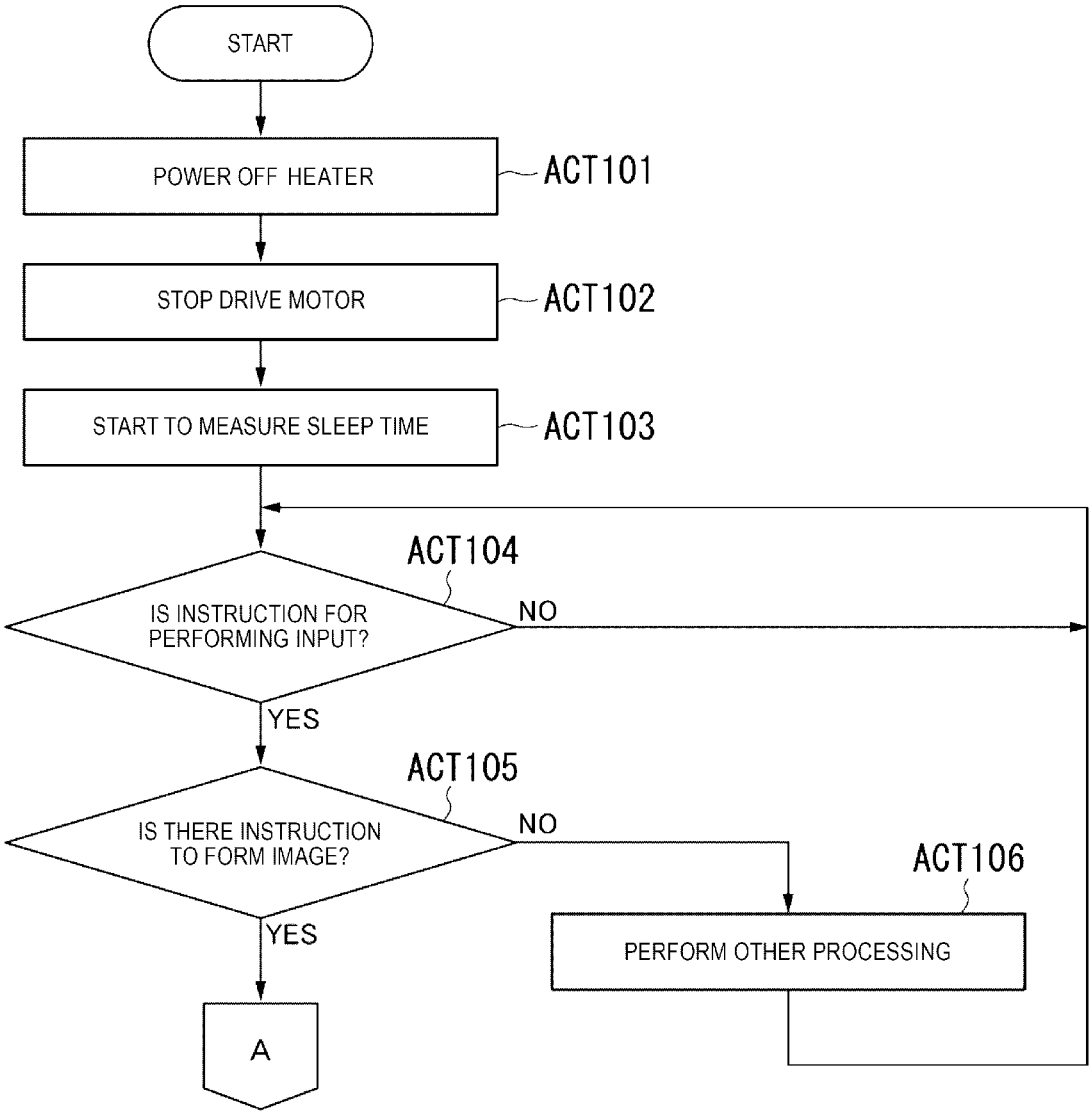
FIG. 9 is a flowchart illustrating a flow for control of the fixation unit according to the first embodiment.
Figure 10:
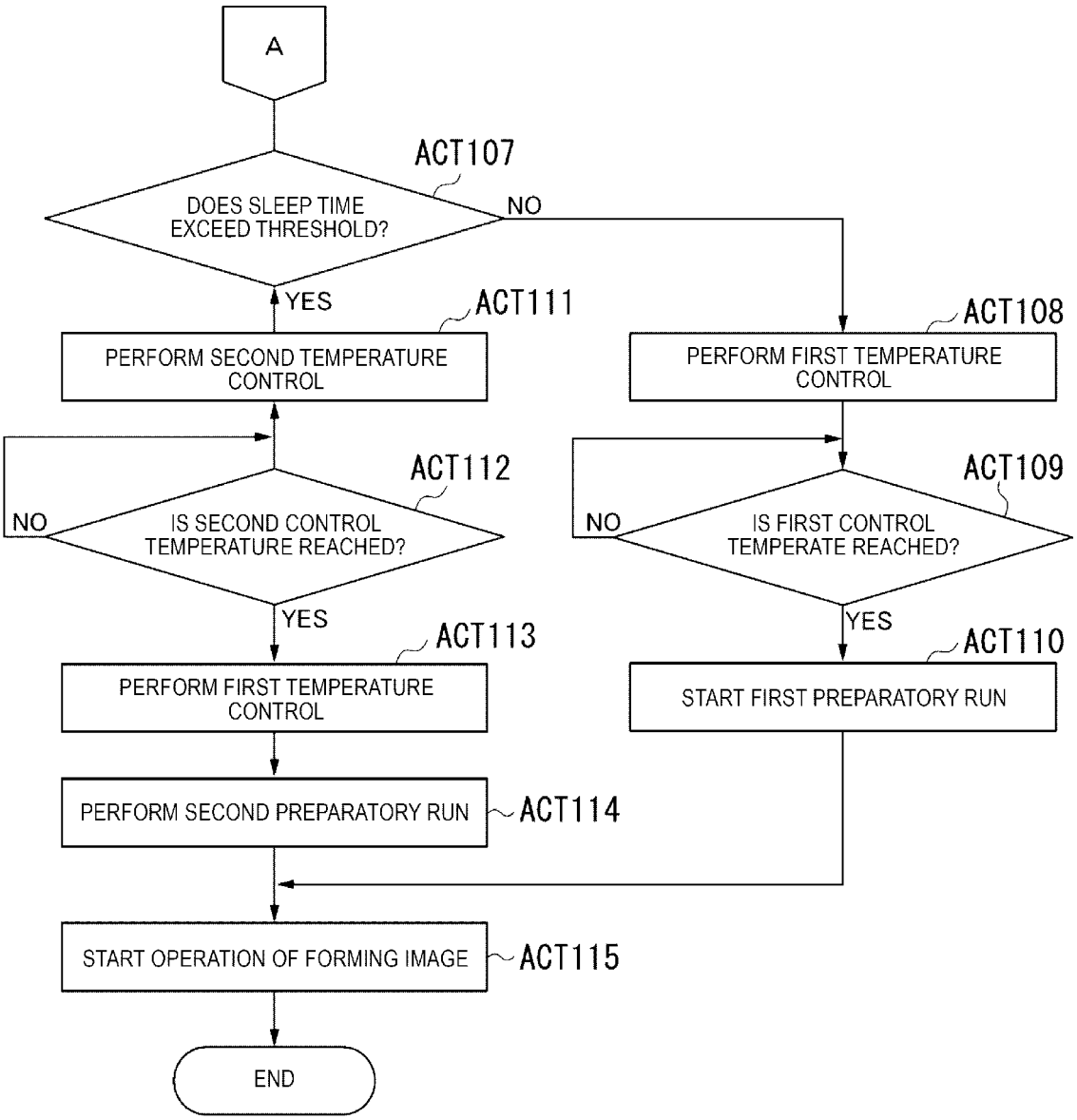
FIG. 10 is a flowchart illustrating the flow for the control of the fixation unit according to the first embodiment.
Figure 12:
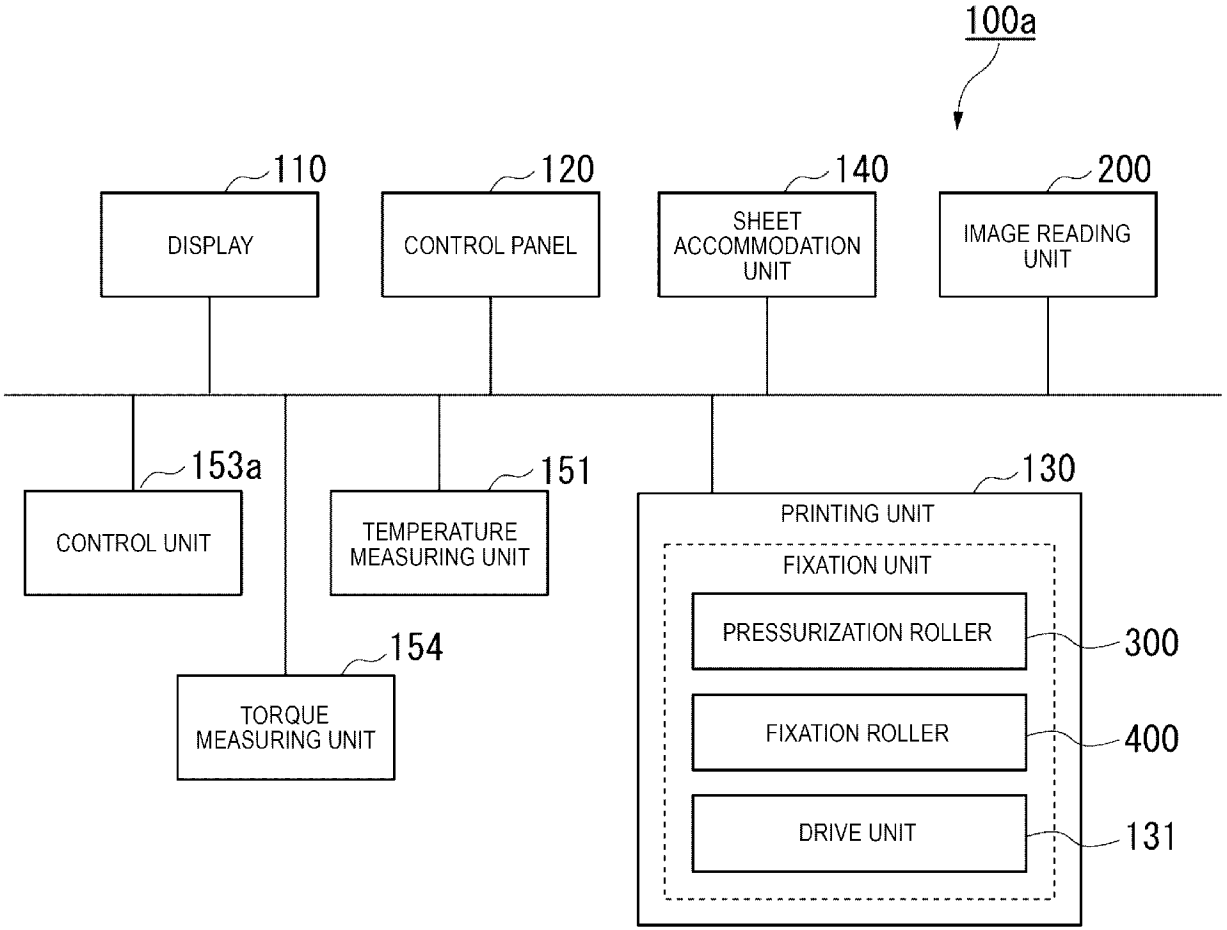
FIG. 12 is a flowchart illustrating a flow for control of a fixation unit according to a second embodiment.
Figure 13:
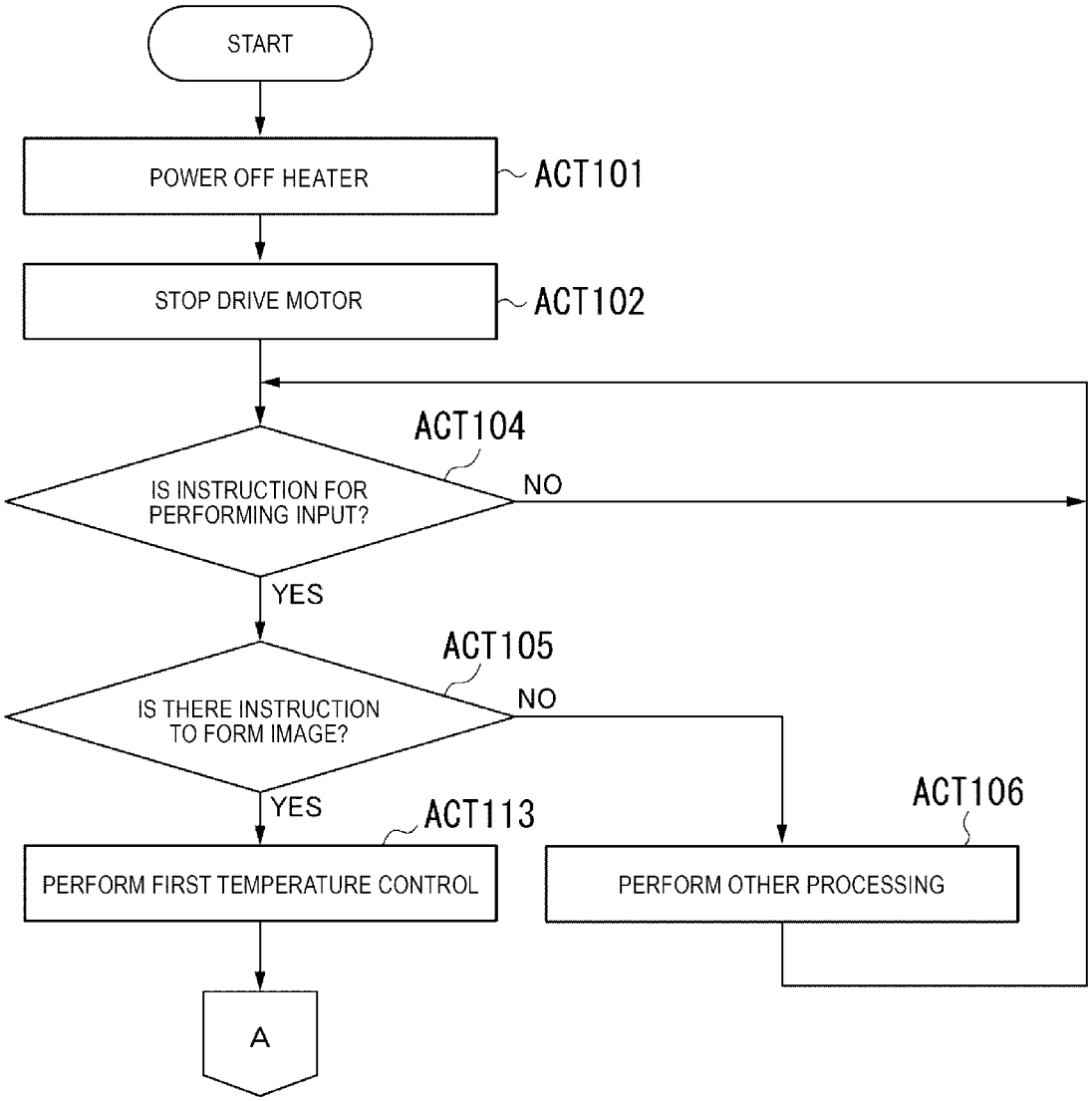
FIG. 13 is a flowchart illustrating the flow for the control of the fixation unit according to the second embodiment.
Figure 14:
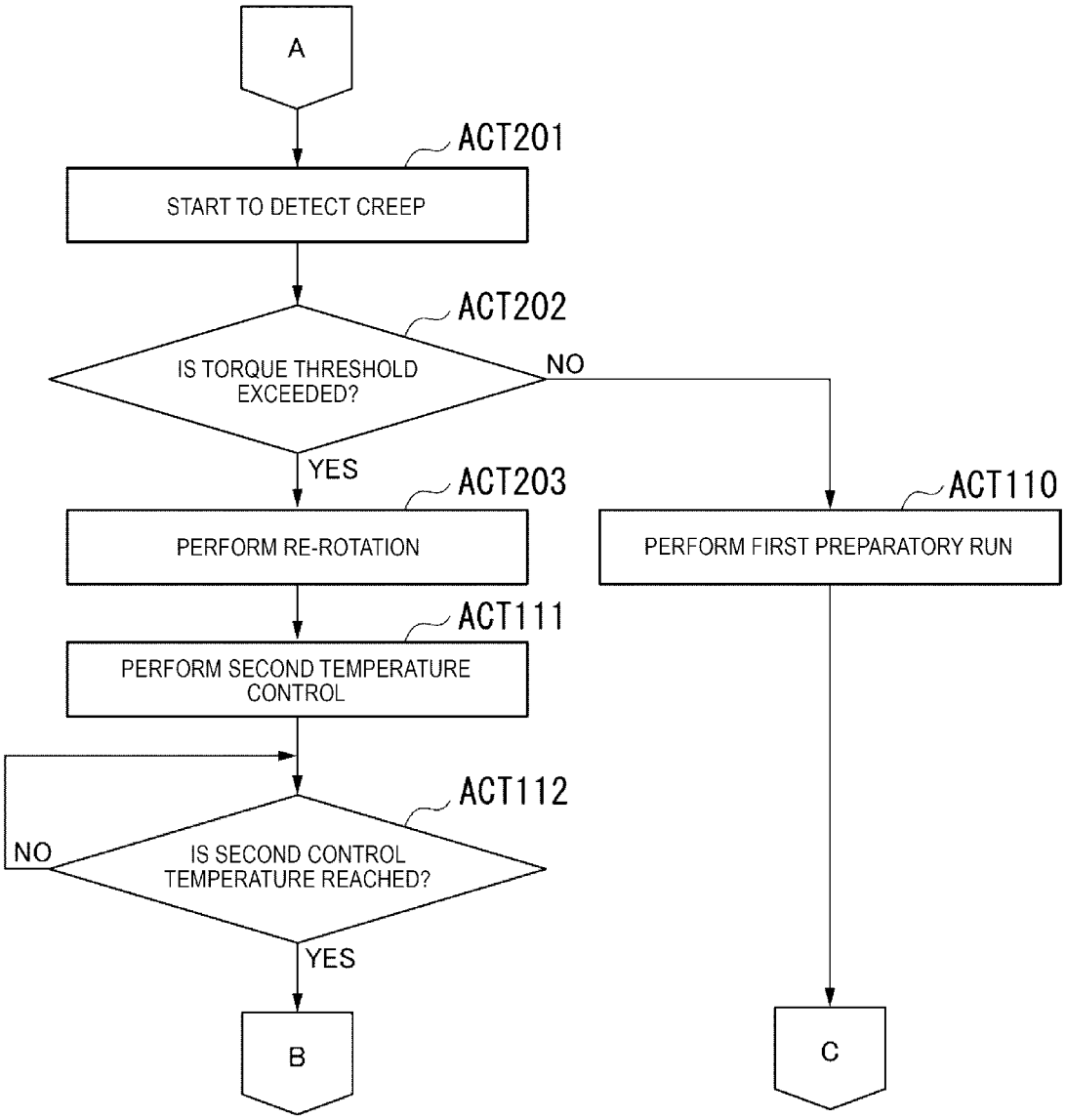
FIG. 14 is a flowchart illustrating the flow for the control of the fixation unit according to the second embodiment.
Figure 15:
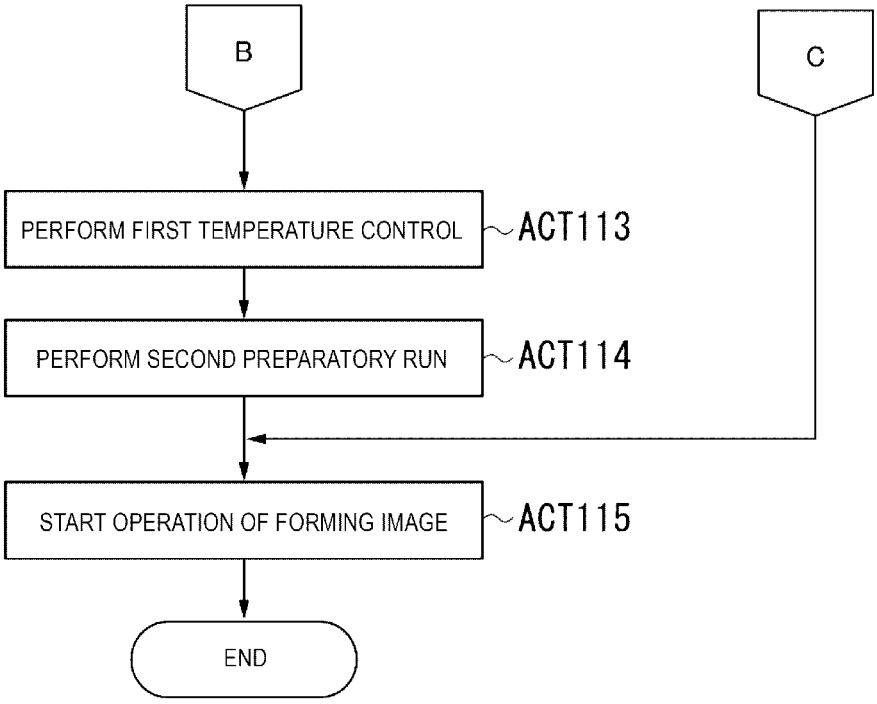
FIG. 15 is a flowchart illustrating the flow for the control of the fixation unit according to the second embodiment.

FIGS. 9 and 10 are flowchart illustrating a flow for control of the fixation unit according to the first embodiment. FIGS. 9 and 10 illustrate downstream processing of the image forming processing and upstream processing before a next image forming processing is performed. At this point, stopping the heater that heats the fixation roller 400 and stopping the motor that causes the drive unit 131 to be driven are described as the downstream processing. First, the control unit 153 powers off the heater (ACT 101) and stops the heating of the fixation roller 400. The control unit 153 causes a power source such as the motor to stop (ACT 102) and causes the operation of the drive unit 131 to stop. When the performing of the downstream processing is finished, the control unit 153 causes the apparatus, to which the control unit 153 itself belong, to transition to the sleep state.

According to the transition of the apparatus to which the control unit 153 itself belongs to the sleep state, the sleep time measuring unit 152 starts to measure the sleep time (ACT 103). The control unit 153 determines whether or not an instruction to perform various types of processing is input into the apparatus to which the control unit 153 itself belongs (ACT 104). For example, the instruction for performing is input through the control panel 120. The control unit 153 determines the presence or absence of the input of this instruction for performing based on input information that is output from the control panel 120.

If the instruction for performing is not input (NO in ACT 104), the control unit 153 repeatedly performs ACT 104 until the instruction for performing is input. On the other hand, if the instruction for performing is input (YES in ACT 104), the control unit 153 determines whether or not the instruction for performing, which is input, is an instruction to perform the image forming processing (hereinafter referred to as an "image formation instruction") (ACT 105). If an instruction to perform processing other than the image forming processing is input (NO in ACT 105), the control unit 153 controls the performance of the processing other than the image forming processing (ACT 106) and returns the processing in ACT 104.

On the other hand, if the image formation instruction is input (YES in ACT 105), the control unit 153 determines whether or not the sleep time exceeds a predetermined threshold (ACT 107). At this point, the predetermined threshold is set as the time that the hardness of the pressurization roller 300 takes to reach the hardness at which the collision sound occurs after (previous) image forming processing is ended. For example, in the case of an example in FIG. 8, a threshold of the sleep time is set to 50 minutes.

If the sleep time does not exceed the threshold (NO in ACT 107), the control unit 153 performs first temperature control (ACT 108). The first temperature control is processing that increases and decreases the temperature of the fixation roller 400 up to the first control temperature. Specifically, the first control temperature is a minimum temperature (hereinafter referred to as a "preparatory-run start temperature") at which a preparatory run can be started.

Generally, the image forming apparatus performs the upstream processing that causes the fixation roller 400 to be rotated in a prepared manner, as an operation in preparation for the fixing processing before performing the image forming processing. Generally, the upstream processing is referred to as a preparatory run. The preparatory run is started after the temperature of the fixation roller 400 reaches a predetermined preparatory-run start temperature. Generally, the preparatory-run start temperature is set to be a temperature that is lower than the fixation temperature (for example, approximately 140° C.). It is noted that at a point in time when ACT 106 is performed, the image forming apparatus 100 is in a sleep state, the temperature of the fixation roller 400 is lower than the first control temperature. For this reason, the control unit 153 powers on the heater, and causes processing, which heats the fixation roller 400, to be started. It is noted that the preparatory run is described as a first preparatory run (a first preparatory run operation) in order to be distinguished from a second preparatory run that will be described below.

When the fixation roller 400 starts to be heated, the control unit 153 determines whether or not the temperature reaches the first control temperature (ACT 109). If the first control temperature is not reached (NO in ACT 109), the control unit 153 repeatedly performs ACT 109 until the temperature of the fixation roller 400 reaches the first control temperature. On the other hand, if the first control temperature is reached (YES in ACT 109), the control unit 153 causes the first preparatory run to be started (ACT 110).

On the other hand, in ACT 107, if the sleep time exceeds a threshold (YES in ACT 107), the control unit 153 performs a second temperature control (ACT 111). The second temperature control is processing that causes the temperature of the fixation roller 400 to be increased up to the second control temperature. Specifically, the second control temperature is a temperature at which the hardness of the pressurization roller 300 is the hardness at which the occurrence of the collision sound can be avoided. Generally, the second control temperature is a temperature that is higher than the fixation temperature. For example, examples in FIGS. 6 and 8 illustrate that, if the temperature of the pressurization roller 300 is equal to or higher than approximately 40° C., the hardness of the pressurization roller 300 is equal to or lower than 44 degrees. In this case, after the temperature of the fixation roller 400 reaches the second control temperature, the control unit 153 maintains such a state for a predetermined time, and thus causes the temperature of the pressurization roller 300 to be increased up to 40° C. or higher.

FIG. 11 is a diagram illustrating a specific example of a relationship between an occurrence situation of the collision sound and the second control temperature if the preparatory run is started at a point in time at which three hours elapse from when certain image forming processing is ended. FIG. 11 illustrates the occurrence situation of the collision sound during each of the times (0 seconds, 4 seconds, 8 seconds, and 12 seconds) for which the fixation roller 400 is maintained to be at the second control temperature. In FIG. 11, "x" indicates that the collision sound occurs, "4" indicates that the collision sound occurs somewhat less often, and "0" indicates that the collision sound at a non-negligible level occurs.

At this point, if the permitted time (hereinafter referred to as the "permission time") that the fixation roller 400 takes to start the preparatory run after the second control temperature is reached is 0 seconds, the second control temperature is set to 200° C. Furthermore, if the permission time is 0 seconds and the collision sound occurs somewhat less often, the second control temperature may be set to 180° C. Furthermore, if the permission time is 4 seconds, the second control temperature may be set to 180° C. In this manner, the second control temperature may be set based on a level at which the collision sounds occur, the permission time that takes for the preparatory run to be started, or the like.

The description is provided with reference back to FIG. 10. With the second temperature control, the image forming apparatus 100 is in a state where, although the fixation roller 400 is caused to be rotated, the collision sound does not occur.

The control unit 153 determines whether or not the temperature of the fixation roller 400 reaches the second control temperature (ACT 112). If the temperature does not reach the second control temperature (NO in ACT 112), the control unit 153 repeatedly performs ACT 112 until the temperature reaches the second control temperature. On the other hand, if the temperature reaches the second control temperature (YES in ACT 112), the control unit 153 performs the first temperature control (ACT 113). At this point in time, the temperature of the fixation roller 400 is the second control temperature that is higher than the first control temperature. For this reason, the control unit 153 powers off the heater, and waits until the temperature of the fixation roller 400 is decreased to be the first control temperature. Furthermore, when the temperature of the fixation roller 400 is decreased to be the first control temperature, the control unit 153 repeatedly powers on and off the heater, and thus keeps the temperature of the fixation roller 400 adjusted to the first control temperature.

When the temperature of the fixation roller 400 reaches the first control temperature, the control unit 153 causes the second preparatory run (a second preparatory run operation) to be started (ACT 114). In the second preparatory run, the fixation roller 400 is caused to be rotated at a lower rotation speed than in the first preparatory run. Accordingly, the likelihood that the collision sound will occur when the fixation roller 400 is rotated can be further decreased. It is noted that in order to reduce nonuniformity in the temperature of the pressurization roller 300, time (that is, time for driving the fixation roller 400) at which the second preparatory run is performed is desirably set to be lengthened within a permissible range. When the second preparatory run is finished, the control unit 153 instructs each functional unit to start the image forming operation (ACT 115).

The image forming apparatus 100 according to the first embodiment, which is configured in this manner, controls a timing at which the fixation roller 400 starts to be rotated, according to the presence or absence of the creep that is estimated based on the length of the sleep time, and thus it is possible that the collision sound is suppressed from occurring at the time of the image forming processing.

Second Embodiment

FIG. 11 is a diagram illustrating a specific example of a functional configuration of an image forming apparatus 100*a* according to a second embodiment. The image forming apparatus 100*a* is different from the image forming apparatus 100 according to the first embodiment in that instead of the sleep time measuring unit 152, a torque measuring unit 154 is included and that instead of the control unit 153, a control unit 153*a* is included. The other functional units are the same as those of the image forming apparatus 100 according to the first embodiment. For this reason, the same functional units are given the same reference numerals as in FIG. 5, and descriptions thereof are omitted.

The torque measuring unit 154 measures torque (one example of a load) of the pressurization roller 300 (or the fixation roller 400). The torque measuring unit 154 outputs torque information indicating the measured torque to the control unit 153*a*.

The control unit 153*a* (one example of an estimation unit and a control unit) acquires the temperature information and the torque information from the temperature measuring unit 151 and the torque measuring unit 154, respectively. Based on the torque that is indicated by the acquired torque information, the control unit 153*a* estimates the presence or absence of the creep in the pressurization roller 300. As described above, with the rotation of the fixation roller 400, the creep portion reaches the abutting surface in contact with the pressurization roller 300, the rotation of the pressurization roller 300 is temporarily accelerated with the pressure contact force. For this reason, torque of the pressurization roller 300 is increased. The control unit 153*a* measures a change in this torque, and thus can estimate the presence or absence of the creep and can detect an endpoint of the creep. Furthermore, based on a position of the detected endpoint of the creep and an amount of rotation of the fixation roller 400, the control unit 153*a* can estimate a next timing at which the creep reaches the abutting surface. Based on the presence or absence of the creep that is identified in this manner, the control unit 153*a* controls the operation of the fixation unit.

FIGS. 12, 13, 14, and 15 are charts illustrating a flow for control of the fixation unit according to the second embodiment. At this point, processing that is the same as that according to the first embodiment is given the same reference numeral as in FIGS. 9 and 10, and thus a description thereof is omitted.

After performing the first temperature control, in order to detect the creep, the control unit 153*a* causes the fixation roller 400 to be rotated temporarily (ACT 201). The control unit 153*a* acquires the torque information that results while the rotation of the fixation roller 400 is in progress, from the torque measuring unit 154. Based on the acquired torque information, the control unit 153*a* determines whether or not the torque exceeds a predetermined threshold (ACT 202). If the torque does not exceed the threshold (NO in ACT 202), the control unit 153*a* returns to the control in ACT 110, and causes the first preparatory run to be started.

On the other hand, if the torque exceeds the threshold (YES in ACT 202), the control unit 153*a* causes the fixation roller 400 to be rotated until the detected creep again reaches the abutting surface (ACT 203). When the creep again reaches the abutting surface, the control unit 153*a* returns to the control in ACT 110 and performs the second temperature control.

The image forming apparatus 100*a* according to the second embodiment, which is configured in this manner measures the torque that results when the fixation roller 400 is caused to be rotated temporarily, and detects the presence or absence of the creep based on the measured torque. After measures the torque, the image forming apparatus 100*a* causes the first or second preparatory run to be started. That is, the image forming apparatus 100*a* can obtain the occurrence situation of the creep more precisely than in the first embodiment in which the presence or absence of the creep is estimated based on the cooling time. For this reason, it is possible that the image forming apparatus 100*a* more efficiently suppresses the collision sound from occurring.

It is noted that, in each embodiment described above, if the occurrence of the creep is estimated, the control unit 153 (or 153*a*) is described as causing the temperature of the fixation roller 400 to be increased up to the second control temperature and then to be decreased up to the first control temperature, and thereafter causing the preparatory run to be started, but in this case, if the temperature of the fixation roller 400 is decreased to at least a ready temperature (one example of a third control temperature) or lower, the control unit 153 may cause the preparatory run to be started without the need to necessarily decease the temperature of the fixation roller 400 up to the first control temperature. At this point, the ready temperature is a temperature at which it is possible that the fixing processing is started. Generally, the ready temperature is set to be a temperature that is somewhat lower than the fixation temperature which is equal to or higher than the first control temperature. The image forming apparatus keeps the temperature of the fixation roller 400, which results after the preparatory run is finished to the ready temperature, and thus it is possible that the image forming apparatus, when instructed to perform the image forming processing, causes the temperature of the fixation roller 400 increase up to the fixation temperature in a short time. Accordingly, the high-speed image forming processing can be realized.

Third Embodiment

An image forming apparatus 100*b* according to a third embodiment is different from the image forming apparatuses according to the first and second embodiments in that a stopper 132 is further included which prevents the pressurization roller 300 from being recessed into the fixation roller 400 due to the cooling over a long period of time.

Figure 16:
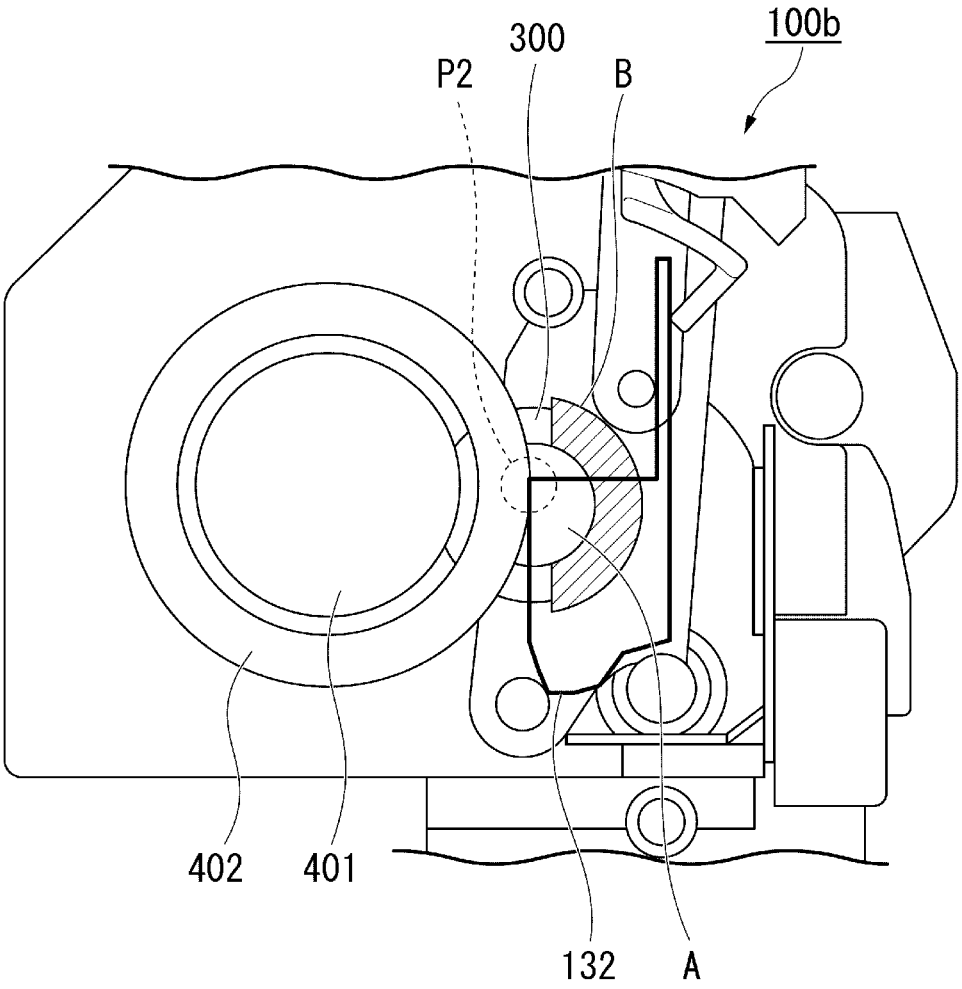
FIG. 16 is a three-dimensional diagram illustrating a specific example of a configuration of an image forming apparatus according to a third embodiment.

FIG. 16 is a three-dimensional diagram illustrating a specific example of a configuration of the image forming apparatus 100*b* according the third embodiment. For example, the stopper 132 is configured to be one portion of the pressurization mechanism that provides the pressure contact force to the pressurization roller 300. An example in FIG. 16 is an example in which the stopper 132 is connected to a support portion B that supports a shaft A of the pressurization roller 300. In this case, with the pressurization mechanism, a pressure contact force is applied in an arrow direction to an indication portion B, and thus the pressure contact force is exerted on the shaft A through a connection portion. Accordingly, the pressure contact force is provided to the pressurization roller 300. The stopper 132 is fixed to a position that, at a point of contact P2, is in contact with a surface of the fixation roller 400. Accordingly, because a position of the pressurization roller 300 is also fixed by the stopper 132, the pressurization roller 300 can be prevented from being recessed into the fixation roller 400 by a longer distance than is necessary.

According to at least one embodiment described above, the control unit is provided that controls a timing at which the preparatory run is started, based on the cooling time for the pressurization roller 300 or the torque of the fixation roller 400, and thus it is possible that the collision sound which occurs in the image forming processing is sufficiently suppressed.

It is noted that in the image forming apparatus that causes the toner with two rotators, the fixation roller that has a cored bar inside and the pressurization roller that has the elastic layer, to be fixed, if the pressurization roller that has a small diameter for miniaturization of the apparatus is used, the amount of creep is easily increased. According to the embodiments described above, even if the pressurization roller that has a small diameter is used in this manner, the collision sound can be effectively suppressed.

It is noted that the fixation roller 400 is one example of the fixation member. Furthermore, the pressurization roller 300 is one example of the pressurization member. If the fixation member and the pressurization member are drive members that are pressure-contacted and come into contact with each other and are mechanism which, when driven, has the likelihood that a strange sound will occur due to the creep that occurs in an abutting portion, no limitation to aspects of rollers is imposed. Furthermore, a halogen lamp that includes the fixation roller 400 inside is one example of the heat source. No heat source that heats the surface of the fixation roller 400 is limited to the halogen lamp.

Furthermore, the drive gear G1 that provides the rotation force to the fixation roller 400 is one example of the drive unit. Furthermore, the rotation force that is provided by the drive gear G1 to the fixation roller 400 is one example of the drive force. No drive unit that provides the drive force to the fixation member (or the pressurization member) according to an aspect of the fixation member (or the pressurization member) is limited to an aspect of the gear.

Furthermore, the sleep time is one example of the elapsed time. If the elapsed time is the time for which the pressurization member is cooled, the elapsed time is not limited to the sleep time. For example, the elapsed time may be the time that the image forming apparatus takes to be powered on after powered off.

In this embodiment, 'decoloring' means to make it difficult to recognize a color of an image formed on an image receiving member after the image is formed on the image receiving member by a recording material which has different color from the color of the image receiving material. The color of recording material may be achromatic color including black or white, not limiting to chromatic color. And in the following embodiment, decoloring the image' means 'erasing the image'.

While certain embodiments have been described, these embodiments have been presented by way of example only, and are not intended to limit the scope of the inventions. Indeed, the novel embodiments described herein may be embodied in a variety of other forms: furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a fixation member;

a pressurization member that is pressure-contacted with the fixation member;

a heat source that heats the fixation member;

a drive unit configured to provide a drive force to the fixation member;

a measurement unit configured to measure an elapsed time from powering off the heat source until receipt of an instruction to perform a next image forming processing; and according to receipt of the instruction to perform the next image forming processing, a control unit configured to cause the drive unit to start to drive the fixation member after a temperature of the fixation member reaches a first control temperature if the elapsed time does not exceed a predetermined threshold, and to cause the drive unit to start to drive the fixation member after the temperature of the fixation member reaches a second control temperature that is higher than the first control temperature if the elapsed time exceeds the predetermined threshold.

2. The image forming apparatus according to claim 1, wherein the measurement unit is further configured to begin measuring the elapsed time when the heater is powered off and stopped a rotation.

3. The image forming apparatus according to claim 1, wherein, if the elapsed time exceeds the predetermined threshold, the control unit causes the fixation member to start to be driven after a predetermined time elapses after the temperature of the fixation member reaches the second control temperature.

4. The image forming apparatus according to claim 1, wherein the fixation member is a roller that is rotated by the drive force, the pressurization member is a roller that is rotated by rotation of the fixation member, and in a preparation operation that is performed if the elapsed time exceeds the predetermined threshold, the control unit causes the fixation member to be rotated at a rotation speed that is lower than a rotation speed at which the fixation member is rotated in a preparation operation that is performed if the elapsed time does not exceed the predetermined threshold.

5. The image forming apparatus according to claim 1, wherein, in a preparation operation that is performed if the elapsed time exceeds the predetermined threshold, the control unit causes the fixation member to be driven for the time that is longer than the time for which the fixation member is driven in a preparation operation that is performed if the elapsed time does not exceed the predetermined threshold.

6. The image forming apparatus according to claim 1, wherein, if the elapsed time exceeds the predetermined threshold and if the second control temperature is a temperature that is higher than a fixation temperature of a toner, the control unit causes the fixation member to start to be driven after a temperature of the fixation member is decreased to a third control temperature that is equal to or higher than the first control temperature and is lower than the fixation temperature.

7. The image forming apparatus according to claim 1, wherein the heat source comprises a halogen lamp.

8. The image forming apparatus according to claim 1, wherein the fixation member is a roller having a cored-bar layer made of metal and a resin material.

9. The image forming apparatus according to claim 1, wherein the resin material comprises polytetrafluoroethylene.

10. The image forming apparatus according to claim 1, wherein the pressurization member is a member formed of an elastic material.

11. The image forming apparatus according to claim 1, wherein the elastic material comprises rubber.

12. A method for operating an image forming apparatus comprising a pressurization member pressure-contacted with a fixation member, comprising:

measuring an elapsed time from powering off the heat source until receipt of an instruction to perform a next image forming processing when the fixation member is driven; and according to reception of the instruction to perform next image forming processing, at least one of:

if the elapsed time does not exceed a predetermined threshold, driving the fixation member after a temperature of the fixation member reaches a first control temperature, or if the elapsed time exceeds the predetermined threshold, driving the fixation member after the temperature of the fixation member reaches a second control temperature that is higher than the first control temperature.

13. The method according to claim 12, wherein if the elapsed time exceeds the predetermined threshold, driving the fixation member after a predetermined time elapses after the temperature of the fixation member reaches the second control temperature.

14. The method according to claim 12, wherein in a preparation operation that is performed if the elapsed time exceeds the predetermined threshold, rotating the fixation member at a rotation speed that is lower than a rotation speed at which the fixation member is rotated in a preparation operation that is performed if the elapsed time does not exceed the predetermined threshold.

15. The method according to claim 12, wherein in a preparation operation that is performed if the elapsed time exceeds the predetermined threshold, driving the fixation member for a time that is longer than the time for which the fixation member is driven in a preparation operation that is performed if the elapsed time does not exceed the predetermined threshold.

16. The method according to claim 12, wherein measuring the elapsed time begins when the heater is powered off and stopped a rotation.

17. The method according to claim 12, wherein if the elapsed time exceeds the predetermined threshold and if the second control temperature is a temperature that is higher than a fixation temperature of a toner, driving the fixation member after the temperature of the fixation member is decreased to a third control temperature that is equal to or higher than the first control temperature and is lower than the fixation temperature.

* * * * *